United States Patent [19]

Naka

[11] 4,236,601

[45] Dec. 2, 1980

[54] TURNING TYPE EMERGENCY ESCAPE

[76] Inventor: Hiromitsu Naka, Tokyo Kenkyusho of Kabushiki Kaisha Naka Gijutsu Kenkyusho, No. 39, Oaza Shinmachi, Yashio-shi, Saitama-ken, Japan

[21] Appl. No.: 974,112

[22] Filed: Dec. 27, 1978

[30] Foreign Application Priority Data

Nov. 2, 1978 [JP] Japan ..... 53-135416

[51] Int. Cl.[3] ..... E06C 9/10; E06C 5/04

[52] U.S. Cl. ..... 182/76; 182/78; 182/100; 182/115; 182/127; 182/195

[58] Field of Search ..... 182/115, 70–74, 182/81, 77, 100, 189, 195, 76, 127, 78

[56] References Cited

U.S. PATENT DOCUMENTS 3,999,627 12/1976 Naka ..... 182/81

4,079,812 3/1978 Naka ..... 182/84

*Primary Examiner*—Reinaldo P. Machado

*Attorney, Agent, or Firm*—Wenderoth, Lind & Ponack

[57] ABSTRACT

A turning type emergency escape is constituted by a rotary stowage box defining an evacuation passage therein, upper and lower covers pivoted to upper and lower portions of the inner side of the evacuation passage, a cover interlocking mechanism interlocking the upper and lower covers for simultaneously opening and closing movements, and a turning mechanism for rotating the stowage box between retracted and protruded positions. An extensible escape means is connected to the stowage box at the evacuation passage and is normally received in the evacuation way for extending out of the stowage box for escape. The extensible escape means has a plurality of telescopically connected pipe sections of different cross-sectional areas.

8 Claims, 8 Drawing Figures

TURNING TYPE EMERGENCY ESCAPE

BACKGROUND OF THE INVENTION

This invention relates to a turning type emergency escape adapted to be mounted on buildings, ships, article hoisting and transporting machines employed in factories, harbours, iron works, mills, shipbuilding yards and mines, construction machines employed in earth-moving sites, mining machines employed in mines and other large size machines and equipment.

Hitherto, there has been used as an emergency escape system for a multi-story building an escape chute, a rope ladder, an escape rope or the like and this has been installed in a box at a point in a room adjacent to the window or emergency exit thereof. When it is to be employed, it must be taken out of a storage box and thrown down through the window or exit and persons on the ground must secure the lower end of the escape system by any suitable means. Thereafter, the evacuees can escape to the safer ground. Thus, the conventional escape system requires a relatively long time for its preparation for use and, in addition, is not able to give simultaneous and quick refuge to a number of evacuees.

Evacuating by a chute simply suspended from the room where an emergency such as fire occurs has been tried, but it tends to be limited with respect to the height of the building where it can be employed and, therefore, it cannot be installed on a large multi-story building.

There has been used an emergency stairway such as a stationary ladder provided outside of the building. However, when such a stairway is provided, the exit door should be locked in order to prevent intrusion of thieves, etc. and various articles tend to be placed adjacent to the exit door. Thus, when an emergency occurs, the door cannot be quickly opened, with the result that many casualities have occurred.

Such emergency stairway is known to be a relatively effective installation, except for its imperfect maintenance. However, the scale and installation position are determined relative to the surrounding buildings and the road condition rather than from the standpoint of the safety of the people in the building where it is installed, because it is normally installed in a manner in which it projects from the building wall. In addition, such a stairway for a multi-story building is a large-scale structure and, therefore, lacks a sense of beauty.

In order to avoid such incidents, an emergency escape means has been proposed which is adapted to be normally contained in an opening in the building wall so as to constitute a part of the building wall and on emergency to be swung down so as to form a veranda permitting evacuation. However, there are many problems to be solved in connection therewith such is usually not equipped with an emergency escape means. Of late, large passenger planes are each equipped with an emergency evacuating.

Article hoisting and transporting machines, construction machines and mining machines each generally has the cab disposed in a position relatively above the ground, but is usually equiped with no emergency escape. Of late, large passenger planes each is equiped with an emergency evacuate chute which is adapted to spread and extend upon being filled with an incombustible gas under pressure in a brief time to thereby form an evacuation passage through which passengers can evacuate from the plane to the ground. However, this type of evacuation chute has to be extended downwardly until the lower end of the chute reaches the ground and thus there are difficulties encountered in mounting the chute on article hoisting and transporting machines, construction machines and mining machines.

SUMMARY OF THE INVENTION

Therefore, one object of the present invention is to provide a turning type emergency escape which can effectively eliminate the disadvantages inherent in the conventional evacuation devices.

Another object of the present invention is to provide a turning type emergency escape means which can be standardized and therefore can be mass produced in a factory.

Another object of the present invention is to provide a turning type emergency escape means which can be easily and simply mounted on newly built and existing buildings, ships, article hoisting and transporting machines, construction machines, mining machines and other large size machines.

Another object of the present invention is to provide a turning type emergency escape means which can extend between higher and lower areas to form an evacuation passage therebetween without the necessity for fixedly securing the lower end thereof to any structure.

Another object of the present invention is to provide a turning type emergency escape means which is easy to manipulate and safe, rapid and positive in operation.

Another object of the present invention is to provide a turning type emergency escape means which allows a number of persons to evacuate in a brief time and maintains a stabilized position under even in a gust of wind to thereby assure safe evacuation of the persons.

BRIEF DESCRIPTION OF THE DRAWINGS

The above and other objects and attendant advantages of the present invention will be more readily apparent to those skilled in the art from the following description when read in connection with the accompanying drawings, in which.

DETAILED DESCRIPTION OF THE INVENTION

Figure 1:
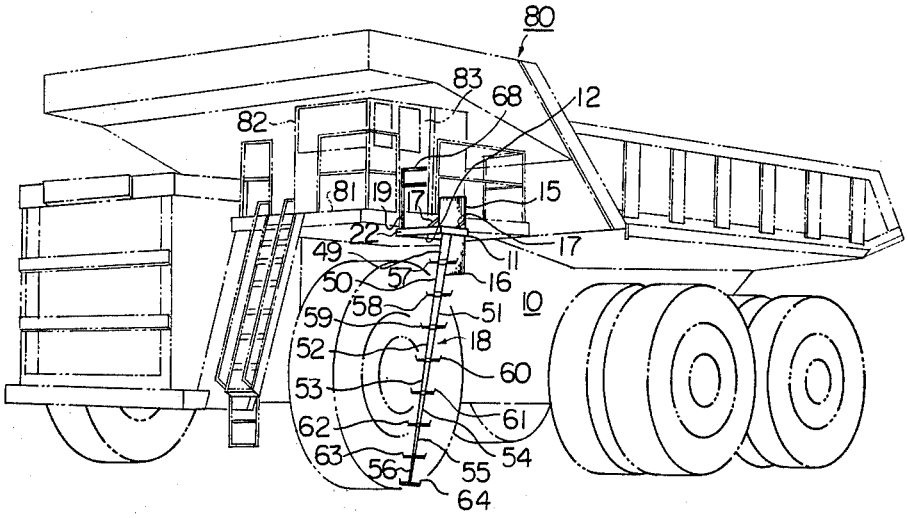
FIG. 1 is a perspective view of one preferred embodiment of the turning type emergency escape means of the present invention mounted on the cab floor of a super-large size dump truck showing the escape means in its protruded position.

The present invention will be now described referring to the accompanying drawings and more particularly to FIGS. 1 through 6 in which one preferred embodiment of the turning type emergency escape means of the present invention is shown.

The turning type emergency escape means 10 is mounted on the underside of a support or of the cab floor 81 positioned on the front part of a dump truck 80 having the cab 82 adjacent to one side edge of the floor where the cab 82 is provided with an access door 83.

The turning type emergency escape means 10 comprises a rotary stowage box 11 rotatably attached to the underside of the cab floor 81 adjacent to the above-mentioned side edge of the cab 82, an evacuation passage 12 defined in the stowage box 11 and having upper and lower openings 13 and 14, an upper cover 15 in the upper opening 13 of the evacuation passage 12 normally closing the top of the evacuation way, a lower cover 16 in the lower opening 14 of the evacuation passage normally closing the bottom of the evacuation way 12, cover interlocking mechanisms 17 interconnecting between the upper and lower covers 15 and 16 for simultaneously opening and closing the two covers, an evacuation means 18 received in the evacuation passage 12 for extending out of the evacuation passage when the escape means is employed and a turning mechanism 19 for the rotary stowage box 11 to rotate the stowage box between the retracted position and the protruded position.

The rotary stowage box 11 has a rectangular shape and comprises a pair of side frame members 20 and a pair of cross frame members 21 extending between and each connected at the opposite ends to the adjacent ends of the side frame members 20. One of the side frame members 20 has a support arm 22 integrally formed therewith and outwardly extending therefrom. The support arm 22 has a hollow boss 23 defining a bore 24 which receives the operating handle of the turning mechanism 19.

Figure 4:
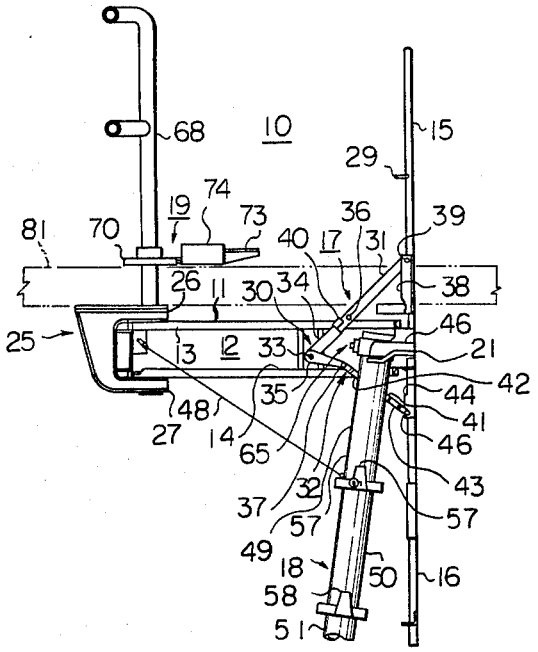
FIG. 4 is a fragmentary sectional view on an enlarged scale of said turning type emergency escape means as seen from the side of said dump truck as shown in FIG. 1.

As more clearly shown in FIG. 4, the rotary stowage box 11 is rotatably held in a hanger 25 which is in turn fixedly secured to the underside of the cab floor 81. More particularly, the hanger 25 comprises vertically spaced upper and lower bosses 26 and 27 which have bores (not shown) vertically aligned with each other. Thus, the rotary stowage box 11 is rotatably attached to the underside of the cab floor 81 by the hanger 25 by aligning the bore 24 in the boss bore 23 of the support arm 22 with the bores in the hanger bosses 26 and 27 and inserting the lower end portion of the operating handle of the turning mechanism 19 into these bores. When the rotary stowage box 11 is rotatably mounted in this way, the stowage box 11, of course, can rotate in a plane parallel to the underside of the cab floor 81.

Furthermore, the rotary stowage box 11 is fixed to the operating handle 66 of the turning mechanism 19 for rotation together with the operating handle 68.

As described hereinabove, the evacuation passage 12 defined in the rotary stowage box 11 consists of the upper and lower openings 13 and 14 and the above-described upper and lower covers 15 and 16 are pivoted to the box 11 adjacent the upper and lower openings 13 and 14 by means of concealed hinges 28.

The upper and lower covers 15 and 16 are connected together by means of the pair of cover interlocking mechanisms so that the upper and lower covers 15 and 16 are opened and closed simultaneously. The upper cover 15 has the handle 29 attached to the inner side thereof for persons being evacuated.

The cover interlocking mechanisms 17 each comprises a substantially L-shaped rotary arm 30 rotatably mounted on a support shaft 33 extending into the evacuation passage 12, a push-up link 31 and a push-down link 32.

The rotary arm 30 comprises a longer arm portion 34 and a shorter arm portion 35 articulately connected together with the leading end of the longer arm portion 34 pivoted to the leading end of the push-up link 31 and the leading end of the shorter arm portion 35 pivoted to the leading end of the push-down link 32.

The rotary arm 30 is not limited to the construction comprising the longer and shorter arm portions 34 and 35 as described hereinabove, but may comprise a triangular plate.

The push-up link 31 is pivoted at the base by a pin 39 to a bracket 38 which is in turn welded to the inner side of the upper cover 15 and has a stop 40 welded thereto to hold the upper and lower covers 15 and 16 in their upright open position when the escape means is employed.

The push-down link 32 comprises a threaded bar 41 and sleeve nuts 42 and 43 screwed on the opposite end portions of the threaded bar 41 so that the length of the push-down link 32 can be adjusted. For this purpose, the sleeve nut 42 on the leading end portion of the threaded bar 41 is pivoted to the shorter arm portion 35 by a pin 37 and the sleeve nut 43 on the base end portion of the threaded bar is pivoted to the inner side of the lower cover 16. The sleeve nut 43 on the base end portion of the threaded bar 41 is, of course, pivoted by a pin 45 to a bracket 44 welded to the inner side of the lower cover 16.

Figure 3:
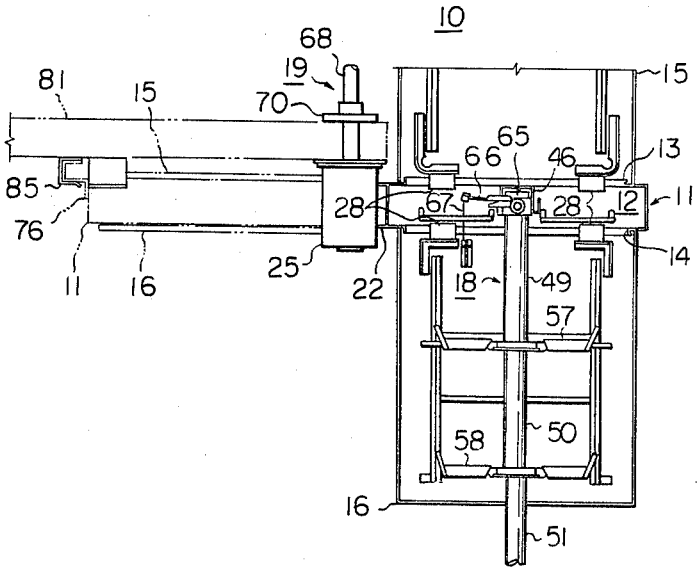
FIG. 3 is a fragmentary sectional view on an enlarged scale of said turning type emergency escape means as seen from the front of said dump truck.

As more clearly shown in FIGS. 1, 3 and 4, the evacuation means 18 is disposed within the evacuation passage 12 defined by the rotary stowage box 11 with one end pivoted to the inner side of one of the cross frame members 21 on a bracket 46 and normally received in the stowage box 11 in the telescopically contracted position. When the escape means 18 is telescopically extended to the ground, the angle of inclination of the means 18 with respect to the rotary stowage box 11 is regulated to a predetermined value by means of a pair of wire ropes 48.

The evacuation means 18 comprises eight slidable pipe sections 49, 50, 51, 52, 53, 54, 55 and 56 of different elliptical cross-sectional areas which have smaller sizes in the downward direction and are telescopically connected together. The slidable pipe sections 49, 50 . . . 56 have rungs 57, 58 . . . 64 attached to the lower ends of the pipe sections and extending transversely of the associated pipe sections, respectively. The upper end of the topmost pipe section 49 of the escape means 18 is rotatably attached to the bracket 46 on the escape passage 12 by means of a support shaft 47. When employed, the evacuation means 18 is telescopically extended from the stowage box 11 toward the ground and suspended from the escape way 12.

The pipe sections 49, 50 . . . are so connected together that when the evacuation means 18 is retracted into the stowage box 11, the pipe sections 50, 51 . . . 64 are telescopically received into the respective adjacent next higher pipe sections 49, 50 . . . 64 and when the means 18 is extended, the pipe sections 50, 51 . . . 64 are telescopically extended out of the respective adjacent next higher pipe sections 49, 50 . . . 63. When the escape means is to be stored, the pipe section assembly is pulled up and rotated about the support shaft 47 to the horizontal position and received in the evacuation passage 12 or laid on the lower cover 16 when the latter is in the closed position.

The escape means 10 further comprises a manual hoist 65 attached to the upper end of the topmost pipe section 49 and the manual hoist 65 comprises a drum (not shown) having a ratchet mechanism (not shown), a wire rope having one end anchored to the drum and the other end anchored to the lowermost pipe section 56 and wound about the drum or payed out of the drum and a brake device (not shown).

As more clearly shown in FIG. 3, the hoist 65 is so constructed that the operation lever 66 is connected to the lower cover 16 by a hook bar 67 to operate the operation lever 11 in response to the opening movement of the upper and lower covers 15 and 16 whereby the ratchet mechanism is released. Thus, when the upper and lower covers 15 and 16 are opened, the opening lower cover 16 operates the operation lever 66 of the hoist 65 through the hook bar 67 to thereby trip the ratchet mechanism of the hoist 65 whereupon the evacuation means 18 is allowed to extend toward the ground under the effect of gravity. As the escape means 18 extends, the brake device of the hoist 65 is actuated to control the descending speed of the evacuation means 18. When the extended escape means 18 is to be retracted, the drum is rotated by the handle (not shown) of the hoist 65 to wind the wire rope about the drum to slidably and telescopically draw the pipe sections 50, 51 . . . 55 into the respective adjacent next higher pipe sections 50, 51, 56 and then retract the emergency evacuation means 18 into the escape passage 12.

Figure 2:
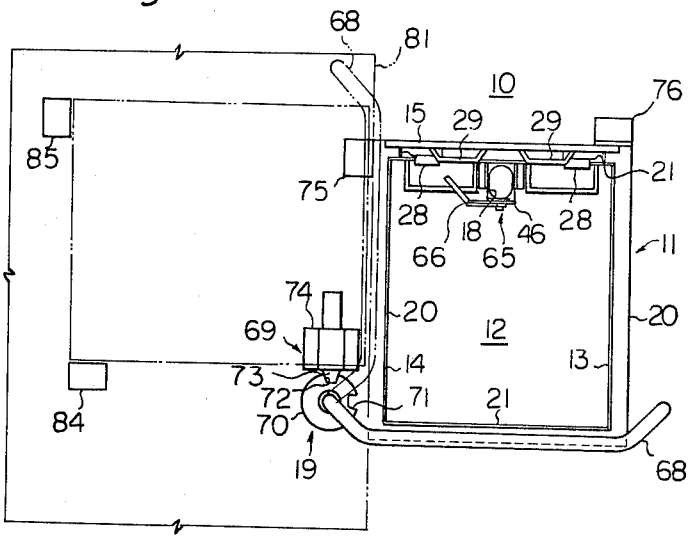
FIG. 2 is a top plan view on an enlarged scale of said turning type emergency escape means as shown in FIG. 1.

As more clearly shown in FIGS. 2, 3 and 4, the turning notches 71 and 72 in the periphery of the disc, a foot through the cab floor 81 with the lower end portion received in the bores in the bosses 26 and 27 of the hanger 25 and the bore 23 in the support arm 22 and having the above-described support arm 22 at the extreme lower end and a locking mechanism 69 for the operating handle 68.

The locking mechanism 69 is adapted to hold the operating handle 68 on the cab floor 81 and also hold the rotary stowage box 11 on the cab floor 81 and comprises a disc 70 secured to the operating handle 68 and having notched grooves 71, 72 formed in the periphery of the disc, a foot pedal type locking lever 73 disposed on the upper surface of the cab floor 81 for selectively engaging the notches 71 and 72 and a locking spring (not shown) for the locking lever 73. The locking lever 73 is rockably mounted on a hat-shaped bracket 74 secured to the upper surface of the cab floor 81 by means of a pin.

The above described turning type emergency escape 10 is held in position on the cab floor 81 in the retracted position by engaging auxiliary arms 75 and 76 on the rotary stowage box 11 into supports 84 and 85 of U-shaped cross-section, respectively, which are secured to the underside of the cab floor 81.

Assuming that a fire occurs in the dump truck and the driver tries to evacuate from the truck cab 82 to the ground, first of all the driver steps down on the locking lever 73 against the force of the locking spring to disengage the lever 73 from the notch 71 in the disc 70. With the locking lever 73 maintained in the disengaged position by the driver's foot, the driver then pushes the operating handle 68 outwardly to the position as shown in FIGS. 2, 3 and 4 whereupon the driver releases his foot from the locking lever 73 whereby the locking lever 73 is caused to engage in the other notch 72 in the disc 70 under the force of the locking spring to lock the operating handle 68 to the cab floor 81 again.

As the operating handle 68 is rotated in the manner described above, the rotary stowage box 11 is also rotated to the protruded position as shown in FIGS. 2, 3 and 4 and locked to the cab floor 81.

Then, the upper cover 15 is pivoted upwardly to the open position and in response to the upward pivotal movement of the upper cover, the lower cover 16 is pivoted downwardly to the open position through the cover interlocking mechanisms 17. As the lower cover 16 is opened, the evacuation means 18 pivoted to the lower cover 16 is also pivoted downwardly about the support shaft 47 to the open position and at the same time, the pivoting lower cover 16 operates the operating lever 66 of the hoist 65 through the hook bar 67 to release the ratchet mechanism.

Thus, as more clearly shown in FIGS. 1, 2, 3 and 4, the escape means 18 is allowed to extend downwardly by its own weight under the control of the brake device.

Thereafter, the driver transfers from the cab floor 81 onto the escape means 18 and then descends down the successive rungs 57 one after another to the ground from where the driver evacuates to a safe place.

If it has been found that the escape 10 has no defects and functions normally through inspections conducted after the use of the escape, the manual hoist 65 is first driven to pull the extended evacuation means 18 up by means of the wire rope and then locked in the raised position by the ratchet mechanism.

The raised evacuation means 18 is then pivoted upwardly about the support shaft 47 to the horizontal position and with the escape means 18 maintained in the raised horizontal position, the upper cover 15 is pivoted downwardly to the closed position and as a result, the lower cover 16 is pivoted upwardly to the closed position carrying the means 18 therewith to retract the escape means 18 into the evacuation passage 12.

Thereafter, the driver steps down on the locking lever 73 against the force of the locking spring to disengage the locking lever 73 from the notch 72 in the disc 70 so as to release the locking mechanism 69 and the driver then pulls the operating handle 68 inwardly to rotate the handle and releases his foot from the locking lever 73 to lock the locking mechanism 69.

As a result, the rotation mechanism 19 and accordingly, the rotary stowage box 11 is locked to the cab floor 81.

Figure 6:
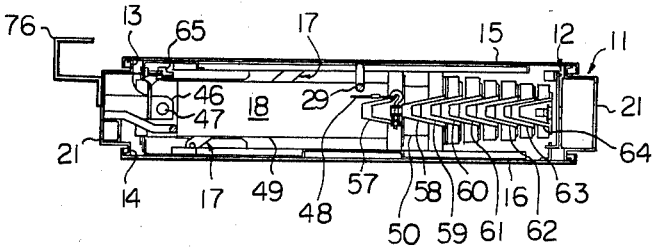
FIG. 6 is a cross-sectional view taken substantially along the line 6—6 of FIG. 5.
Figure 5:
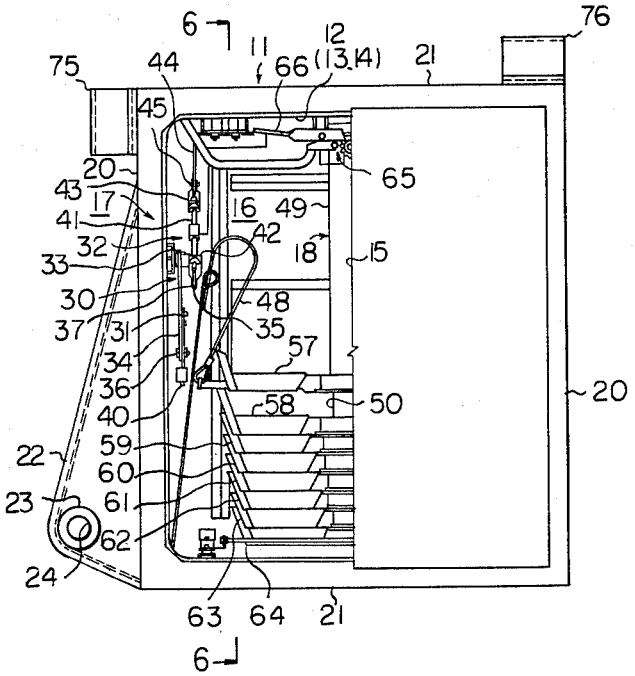
FIG. 5 is a top plan view on an enlarged scale of the rotary stowage box of said turning type emergency escape means as shown in FIG. 1 showing the escape means received in said rotary stowage box with a portion thereof broken away.

By the procedure described just above, the rotary stowage box 11 is retracted into the initial position right below the cab floor 81 and locked thereto and the turning type emergency escape means 10 is returned to the initial position as shown in FIGS. 5 and 6.

Figure 7:
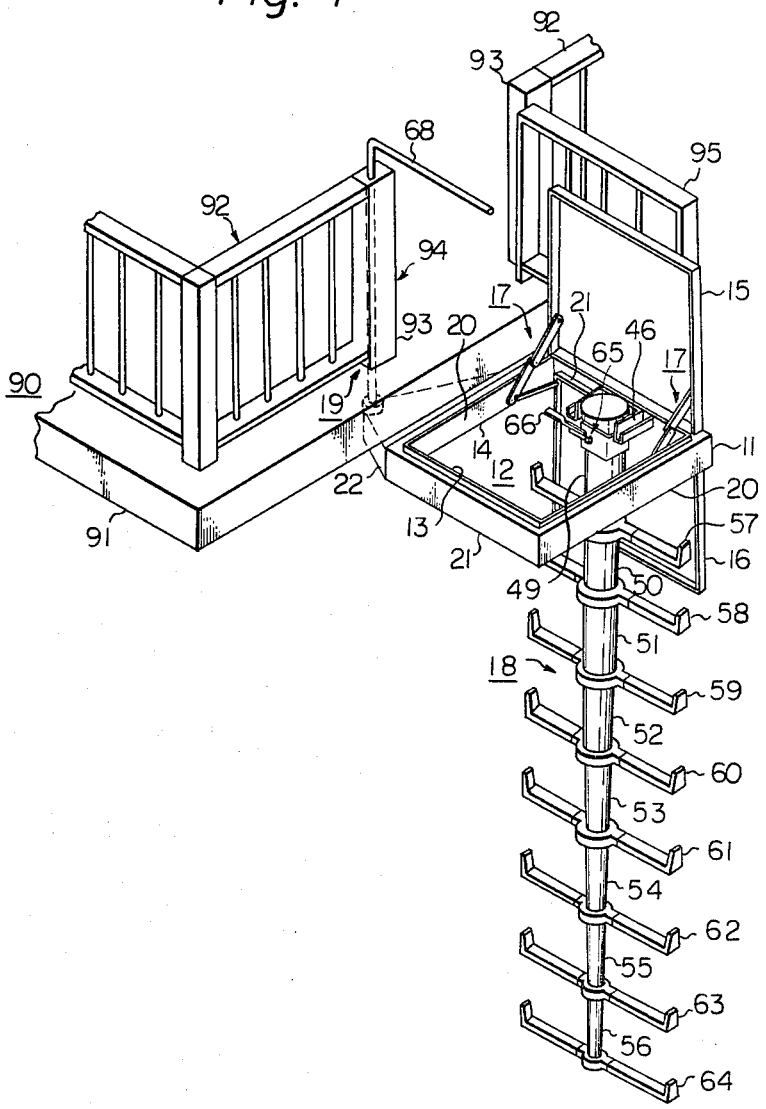
FIG. 7 is a perspective view of said turning type emergency escape means of FIG. 1 as being mounted on the veranda of the second floor of a multi-story building showing the escape means in its protruded position.

FIG. 7 schematically shows the turning type emergency escape means 10 of the present invention applied to a multistory building 90.

The turning type emergency escape means 10 is mounted on the veranda 91 of the second floor of the building so that occupants on the second floor can evacuate from the floor to the ground by way of the escape means 10. In this case, the turning type escape means 10 is mounted on the veranda 91 in the same manner as that in which the escape is mounted on the cab floor of the dump truck as described hereinabove. In this case, the operating handle 66 extends through one of the posts 93 which defines an emergency exit 94 in the railing 92 of the veranda 91.

Assuming that a fire occurs on the second floor of the building and occupants on the floor try to evacuate from the floor to the ground, any one of the occupants first opens the railing door 95 which opens and closes the emergency exit 94 and then steps down on the locking lever 73 against the force of the locking spring to disengage the lever from the notch 71 in the disc 70, pushes the operating handle 68 outwardly to rotate the handle to the position as shown in FIG. 7 with the locking lever 73 maintained in the depressed position and then releases the locking lever 73 to allow the locking spring to engage in the notch 72 in the disc 70 under the force of the locking spring to thereby lock the operating handle 68 to the veranda 91 again.

As the operating handle 68 is rotated in the manner as described just above, the rotary stowage box 11 is also rotated to the position as shown in FIG. 7 and locked to the veranda 91.

Thereafter, by the same procedure as described in connection with the turning type emergency escape means 10 mounted on the dump truck 80, the user pivots the upper and lower covers 15 and 16 to the open position and allows the evacuation means 18 to extend downwardly toward the ground whereby the occupants on the second floor can evacuate from the floor to the ground by descending down the extended means 18.

If it has been found that the escape means has no defects and functions normally through inspections conducted after the use of the escape means, in the same manner as described in connection with the emergency escape means 10 mounted on the dump truck 80, the evacuation means 18 is pulled up and received in the evacuation passage 12, the upper and lower covers 15, 16 are pivoted to the closed position and the turning mechanism 19 is operated to return the escape to the initial position.

Figure 8:
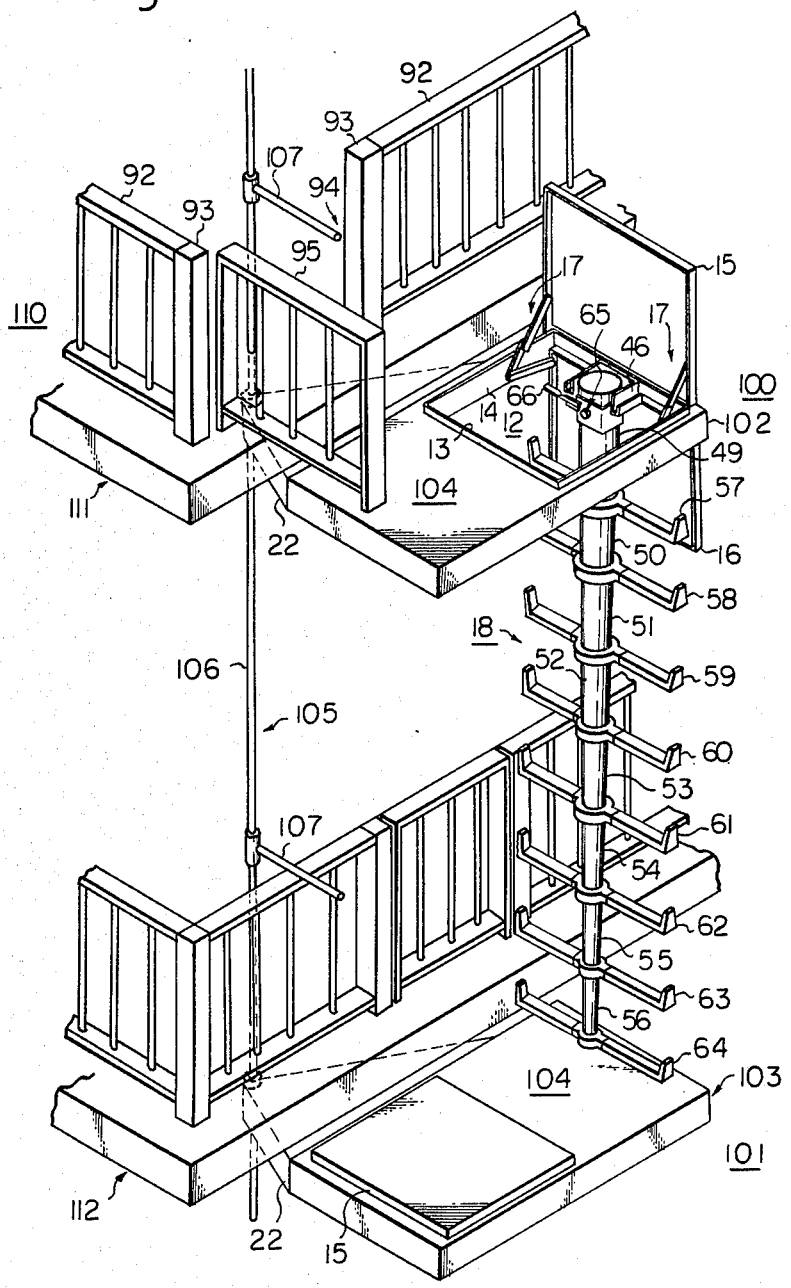
FIG. 8 is a perspective view of modified turning type emergency escape means mounted on the verandas of the floors of a multi-story building such as an apartment house showing the escape means in the protruded position.

FIG. 8 schematically shows a modified embodiment of the rotary emergency escape of the invention adapted to be mounted on each of the different floors of a multi-story building such as an apartment house. In this Figure, two turning type emergency escape means 100 and 101 of the modified embodiment are shown as being mounted on two selected floors of the building.

The escape means 100 is mounted on the veranda 111 of a higher floor of the two floors and the escape means 101 is mounted on the veranda 112 of the lower floor. In use, the escape means 100 on the higher floor communicates with the lower floor escape means 101 to form an evacuation path between the two floors. By repeating the procedure to the first floor of the same building adjacent to the ground, the evacuation path extends to the ground.

The escape means 100 and 101 are substantially similar to the escape means 10 of FIGS. 1 through 6 except that the rotary stowage box 11 and the operating handle 68 and locking lever 73 of the turning mechanism 19 are modified.

The rotary stowage boxes 102 and 103 of the turning type emergency escape means 100 and 101 are provided with landings 104 and the landings 104 of the escape means 100 and 101 are staggered relative to each other and thus, the evacuation means 18 of the turning type escape means 100 can extend to the landing 104 of the turning type emergency escape means 101. Instead of providing separate rotation mechanisms similar to the turning mechanism 19 of the above-described escape means 10 on the two escape means 100 and 101 for the two building floors, a common turning mechanism 105 serves for the two escapes escape means 100 and 101 and the turning mechanism 105 comprises an interlocking turning rod 106 which extends through the bores in the verandas 111 and 112 of the two floors, the bores (not shown) in the hangers 25 of these escape means 100 and 101 and the bores 24 in the support arms 22 for the rotary stowage boxes 102 and 103 and operating handles 107 are mounted on the common interlocking turning rod 106 at different heights along the rod for different floors. The locking levers 73 of the turning mechanism 105 for the two floors are connected together by means of interlocking rods (not shown) which extend through the respectively associated floors.

Since the turning type emergency escape means 100 and 101 are mounted on the verandas 111 and 112 of the two floors of the multi-story building, assuming that a fire occurs on the upper floor, occupants on the upper floor can evacuate from the floor to the ground through the escape means 100 and 101. That is, any one of the occupants on the upper floor first steps down on the turning mechanism locking lever 73 of the escape means 100 mounted on the veranda 111 against the force of the locking spring to disengage the locking lever 73 from the notch 71 in the disc 70 and at the same time, releases the locking mechanism 69 of the escape means 101 mounted on the veranda 112 of the lower floor and then manually pushes the operating handle 107 outwardly with the locking lever 73 maintained in the depressed position to rotate the lever to the position as shown in FIG. 8 whereupon the user releases his foot from the locking lever whereby the locking lever is caused to engage in the notch 72 in the disc 70 under the force of the locking spring and at the same time the locking mechanism 69 on the veranda of the lower floor is actuated to lock the interlocking turning rod 106 to the verandas 111 and 112 again.

As the rotary mechanism is operated in the manner described just above, the escape means 100 and 101 and more particularly, the rotary stowage boxes 102 and 103 associated with these escape means are operated and rotated to the operative position or the position as shown in FIG. 8 and locked to the verandas 111 and 112, respectively.

Thereafter, the occupants on the upper floor open the railing door 95 on the veranda 111, move onto the landing 104 of the escape means 100 and pivot the upper cover 15 upwardly to the open position whereupon the lower cover 16 is also pivoted to the open position through the cover interlocking mechanisms 17. As the lower cover 16 pivots to the open position, the evacuation means 18 mounted on the lower cover 16 is also pivoted downwardly about the support shaft 47 on the bracket 46 and the downward pivotal movement of the evacuation means 18 in turn operates the hoist 65 through the operation lever 66 to release the ratchet mechanism.

Since the ratchet mechanism is released in this way, as shown in FIG. 8, the evacuation means 18 of the escape means 100 is allowed extend downwardly under its own weight to the landing 104 of the escape means 101 on the lower floor.

Next, the occupants confirm whether the evacuation means 18 of the escape means 100 has extended fully or properly and when they have found that the evacuation means has extend fully, they transfer from the veranda 111 onto the landing 104 of the escape means 100 and descend down the rungs 57 of the evacuation means 18 of the escape means 100 to the landing 104 of the escape 101 on the veranda 112 of the lower floor.

Next, the occupants pivot the upper cover 15 of the escape means 101 upwardly to the open position. The upward pivotal movement of the upper cover 15 of the escape means 101 pivots the lower cover 16 of the same escape means downwardly through the cover interlocking mechanisms 17 of the escape means 101 to allow the evacuation means 18 of the escape means 101 to extend downwardly under its own weight as in the case of the escape means 100.

Then, the occupants confirm whether the evacuation means 18 of the escape means 101 has extended fully or properly and when they have found that the evacuation means has extended fully, they transfer from the landing 104 onto the evacuation means 18 and descend down the rungs 57 of the escape means. The occupants move down the successively lower floors and evacuate to the ground by repeating the same procedure.

When it has been found that the escape means 100 and 101 on the two floors of the multi-story building have no defects and function properly, by following the same procedure as described in connection with the escape 10 mounted on the dump truck 80, the evacuation means 18 of the escape means for the two floors are pulled up and retracted into the associated evacuation passages 12 and the upper and lower covers 15 and 16 of the escapes are pivoted to the closed position. Thereafter, the locking lever 73 of the escape associated with any selected floor is depressed to simultaneously release the locking mechanisms of the common turning mechanism of the escape means associated with the two floors in response to the depressed of the particular locking lever 73. With the locking mechanisms 69 maintained in the released position, the operating handle 107 associated with the particular locking lever 73 is pulled inwardly to turn the interlocking turning rod 106 which in turn retracts the rotary stowage boxes 102 and 103 to the position under the verandas 111 and 112 associated with the different floors. Thereafter, the locking lever 73 is released and the locking mechanisms of the common turning mechanism of the escape means associated with the different floors are locked to thereby return the escape means 100 and 101 to the initial positions.

While preferred embodiments of the invention have been shown and described in detail, it will be understood that the same are for illustrative purposes only and not to be taken as a definition of the invention, reference being had for this purpose to the appended claims.

What is claimed is:

1. A turning type emergency escape means comprising:

a rotary stowage box having means for rotatably mounting said box on a support;

an evacuation passage defined in said stowage box;

an upper cover closing the upper opening of said evacuation passage;

a lower cover closing the lower opening of said evacuation passage;

a cover interlocking means connected between said upper and lower covers for simultaneously opening and closing the two covers;

an extensible evacuation means in said stowage box;

a turning mechanism connected to said stowage box for rotating said stowage box between retracted and protruded positions, said turning mechanism having an operating handle secured at the lower end to said rotary stowage box for rotatably mounting the rotary stowage box on the support; and a locking mechanism for locking said rotary stowage box to the support when the rotary stowage box is in said protruded position.

2. A turning type emergency escape means as claimed in claim 1, in which said locking mechanism comprises a disc secured to said operating handle and having notches in the periphery thereof, a foot pedal type locking lever adapted to be mounted on the support for selective engagement in one of said notches, and a locking spring for holding said locking lever engaged in a notch.

3. A turning type emergency escape means as claimed in claim 1, wherein said cover interlocking means comprises a pair of cover interlocking mechanisms for opening and closing the lower cover in response to the opening and closing movements of the upper cover.

4. A turning type emergency escape means as claimed in claim 3, in which each of said cover interlocking mechanisms includes a support shaft extending into said evacuation passage, a substantially L-shaped rotary arm rotatably mounted on said support shaft, a push-up link having one end pivoted to the longer arm portion of said rotary arm and the other end pivoted to said upper cover and a push-down link having one end pivoted to the shorter arm portion of said rotary arm and the other end pivoted to said lower cover.

5. A turning type emergency escape means as claimed in claim 4, in which said evacuation means comprises a plurality of telescopically interfitted pipe sections having different diameters which decrease in the downward direction of said evacuation means when said evacuation means is extended, transverse rungs attached to said respective pipe sections at the lower end thereof, and the uppermost pipe section being pivotally mounted on said stowage box.

6. A turning type emergency escape means as claimed in claim 5 which said evacuation means further comprises a hoist on said stowage box having a wire rope the lower end portion of which extends through said plurality of telescopically interfitted pipe sections and is connected to the pipe section which is the lowest section when said pipe sections are extended.

7. A turning type emergency escape means as claimed in claim 6 in which said hoist has a ratchet mechanism for controlling the winding up of said wire, said ratchet mechanism having an operating bar, said hoist further comprising a hook bar connecting said operating bar of said ratchet mechanism to said lower cover.

8. A turning type emergency escape system for installation in a multi-story building having a veranda on at least some of the stories, said escape system comprising:

a plurality of escape devices, one for each veranda, and each having:

a stowage box having means for rotatably mounting said box on a veranda;

an evacuation passage defined in said stowage box;

an upper cover closing the upper opening of said evacuation passage;

a lower cover closing the lower opening of said evacuation passage;

a cover interlocking mechanism interlocking said upper and lower covers for simultaneously opening and closing the two covers;

an extensible evacuation means in said stowage box and extendable to the next lower veranda on the building;

a turning mechanism connected to said stowage box for rotating said stowage box between retracted and protruded positions, said turning mechanism including an operating handle secured at the lower end to said rotary stowage box for rotatably mounting the rotary stowage box on the corresponding veranda;

a locking mechanism for locking said rotary stowage box to the veranda when the rotary stowage box is in said protruded position; and a common turning rod interconnecting the operation handles of the turning mechanisms associated with the respective floors of the multi-story building, and handles secured to said common turning rod at the respective floors, and a common connecting rod interconnecting the locking levers of said rotation mechanisms on the respective floors of the building.

* * * * *